US005775632A

United States Patent [19]

Huerta

[11] Patent Number: 5,775,632

[45] Date of Patent: Jul. 7, 1998

[54] MANDREL FOR USE WITH AN APPARATUS FOR DISPENSING MATERIAL FROM A ROLL

[76] Inventor: Joe A. Huerta, 12634 S. 35th Pl., Phoenix, Ariz. 85044

[21] Appl. No.: 656,925

[22] Filed: Jun. 3, 1996

[51] Int. Cl.[6] ..... B65H 49/26

[52] U.S. Cl. ..... 242/597.6; 242/613.2

[58] Field of Search ..... 242/597.5, 597.6, 242/613.1, 613.2

[56] References Cited

U.S. PATENT DOCUMENTS

| | | | |
|---|---|---|---|
| Re. 30,787 | 11/1981 | Pool et al. . | |
| 1,149,317 | 8/1915 | Ahlstrom | 242/613.1 |
| 1,775,610 | 9/1930 | Weiss | 242/597.6 |
| 2,916,226 | 12/1959 | McGraw | 242/613.1 X |
| 3,138,340 | 6/1964 | Caravella | 242/597.5 |
| 3,272,448 | 9/1966 | Caravella | 242/597.5 |
| 3,567,557 | 3/1971 | Kingery et al. . | |
| 3,950,214 | 4/1976 | Pool et al. . | |
| 4,096,021 | 6/1978 | Pool et al. | 156/257 |
| 4,263,347 | 4/1981 | Banta . | |
| 4,357,198 | 11/1982 | Ezquerro . | |
| 4,379,019 | 4/1983 | Pool | 156/257 |
| 4,413,793 | 11/1983 | Komatsubara et al. | 242/597.6 |
| 4,508,587 | 4/1985 | Hunter . | |
| 4,588,469 | 5/1986 | Hunter . | |
| 4,906,322 | 3/1990 | Hollier . | |
| 5,037,501 | 8/1991 | Lawson . | |
| 5,113,921 | 5/1992 | Pool . | |

FOREIGN PATENT DOCUMENTS

| | | | |
|---|---|---|---|
| 5772547 | 5/1982 | Japan | 242/613.1 |
| PCT/US81/01157 | 8/1981 | WIPO . | |

*Primary Examiner*—William Stryjewski
*Assistant Examiner*—Gregory J. Strimbu
*Attorney, Agent, or Firm*—Parsons & Goltry; Robert A. Parsons; Michael W. Goltry

[57] ABSTRACT

In an apparatus for dispensing material from a roll having a frame and a shaft, improvements therein comprising a mandrel rotatably receivable upon the shaft and having an inner tapered lead, an outer tapered lead, and a raised contact portion for contacting portions the core of the roll.

10 Claims, 2 Drawing Sheets

MANDREL FOR USE WITH AN APPARATUS FOR DISPENSING MATERIAL FROM A ROLL

BACKGROUND OF THE INVENTION

1. Field of the Invention

This invention relates to devices for dispensing material from a roll.

More particularly, this invention relates to hand held devices for dispensing material from a roll.

In a further and more specific aspect, the instant invention relates to a mandrel for use in combination with a hand held device for dispensing material from a roll.

2. Prior Art

A mandrel is normally defined as an apparatus for supporting a workpiece. The prior art is replete with mandrels and an array of devices that use them. Of particular interest are apparatus for applying material such as paper to a surface in preparation for painting, trimming and other finishing techniques. In general, such devices, which have achieved broad acceptance by both industrial and non-commercial users alike, and which are normally referred to as hand held masking machines, are employed for protecting a designated portion of a surface from a finish or treatment applied to an adjacent portion of the surface. Exemplary is the general painting and decorative trimming of vehicle bodies, walls of buildings and other large and small items in connection with vocational and avocational pursuits.

Masking machines are available in a variety of sizes and configurations especially adapted for various uses. While having similar function, specifically the dispensing of tape and paper, and having commonly analogous components including a holder for a roll of tape, a holder for a roll of paper, and a cutting edge for severing the tape and the paper, the various masking machines present exceedingly dissimilar appearances. The apron machine, for example, is usually a large, bulky, floor-supported apparatus. The hand held machine, on the other hand, is a relatively lightweight and compact unit.

Exemplary of prior art masking machines, and herein chosen for purposes of orientation in connection with the instant invention, is the hand held device which includes a handled frame having a rotatably affixed paper roll holder and a rotatably affixed tape roll holder for supporting a roll of coiled paper sheet and a roll of coiled, pressure sensitive tape, respectively. The holders, which have parallel axes of rotation, are oriented such that the tape is dispensed along and overlapping an edge of the paper sheet. As the machine is moved along, the paper and the tape are drawn therefrom and the free portion of the tape is adhesively secured to the surface by the wiping action of the curved portion of a guide bar. When the end of the areas to be masked has been reached, the tape and paper are severed by an elongate cutting edge extending from the frame parallel to the axis of rotation of the holders.

The masking machine, as described above, has proven to satisfactorily achieve the objects for which it was devised. This is attested, in part, by commercial success. Observation, however, has indicated an area of interest and concern not before considered in connection with the instant machine or analogous devices.

Paper, for example, is available in various widths. Users, therefore, frequently exchange the roll of paper in accordance with the requirements of the immediate task. As a result, the cardboard tube forming the core of the roll becomes enlarged, impairing proper fit of the roll upon the holder. An analogous problem of improper fit, either too loose or too tight, occurs in new rolls as a result of the inherent variance in the size of cores. To accommodate such concerns, the prior art has devised a variety of mandrels that may be used in combination with rolls having cores of varying size. However, these mandrels are typically difficult and expensive to manufacture, and incorporate elements that are easily broken.

In view of the foregoing and other observations, experimentation has been conducted for the purpose of improving the referenced mandrel.

It would be highly advantageous, therefore, to remedy the foregoing and other deficiencies inherent in the prior art.

Accordingly, it is an object of the present invention to provide a new and improved mandrel.

Another object of the present invention is to provide a mandrel that is easy to use.

And another object of the present invention is to provide mandrel that is inexpensive to manufacture.

Still another object of the present invention is to provide a mandrel that is strong.

Yet another object of the instant invention is to provide a mandrel that is resistant to breakage.

Yet still another object of the instant invention is the provision of a mandrel that may be used in combination with an array of devices requiring little or no modification.

And a further object of the invention is the provision of convenient use of a new and improved mandrel.

SUMMARY OF THE INVENTION

Briefly, to achieve the desired objects of the instant invention in accordance with a preferred embodiment thereof, provided is an apparatus for dispensing material from a roll. The apparatus includes a frame, a shaft extending outwardly from the frame and terminating with a free end and having an outer surface. The roll includes a core having a bore with a diameter defined by a generally cylindrical inner surface. Further provided is a mandrel rotatably receivable or journaled upon the shaft. The mandrel includes, an outer tapered lead terminating with an outer end, an inner tapered lead terminating with an inner end, and a raised engagement surface disposed generally intermediate the inner tapered lead portion and the outer tapered lead portion. The raised engagement surface is operative for engaging portions of the core of the roll. The mandrel further includes a bore receivable about the shaft in a direction from the free end of the shaft.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which.

DETAILED DESCRIPTION OF THE PREFERRED EMBODIMENT

Figure 1:
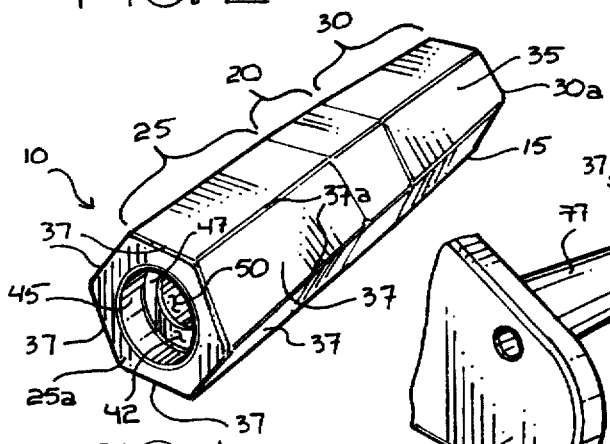
FIG. 1 is a perspective view of an embodiment of the instant invention constructed in accordance with the preferred embodiment comprising a mandrel.

Turning now to the drawings, in which like reference characters indicate corresponding elements throughout the several views, attention is first directed to FIG. 1 which illustrates a first embodiment of the instant invention comprising a mandrel being generally designated by the reference character 10. Mandrel 10, being operative for receiving and retaining a roll of material, details of which will be further discussed shortly, includes a unitary generally elongate member 15 having a raised portion 20, a generally tapered inner lead portion 25, and a generally tapered outer lead portion 30. Inner lead portion 25 and outer lead portion extend outwardly from raised portion 20 in generally diametrically opposed directions and terminate with an inner end 25*a* and an outer end 30*a* respectively. Preferably constructed of a substantially rigid material such as plastic or other preferred and suitable material, mandrel 10 may be formed having any preferred and selected width, height, and length, as desired to suit specific needs.

Figure 2:
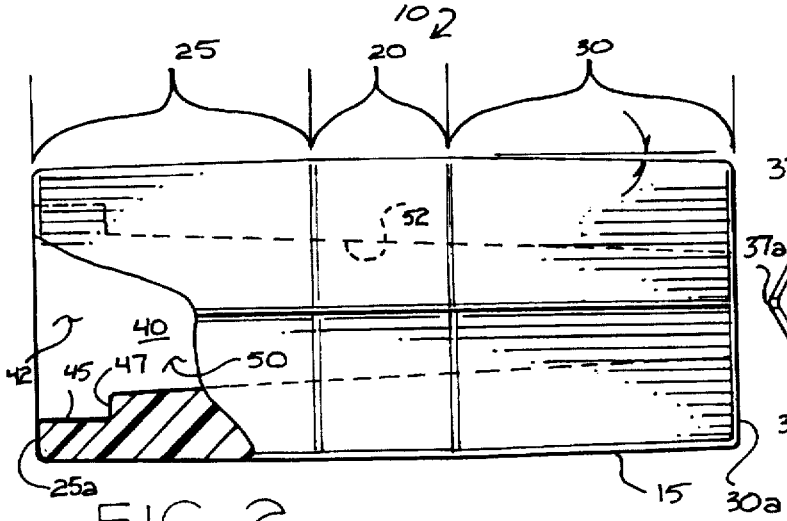
FIG. 2 is an enlarged side elevational view of the mandrel shown in FIG. 1, with portions broken away for the purpose of illustration.
Figure 3:
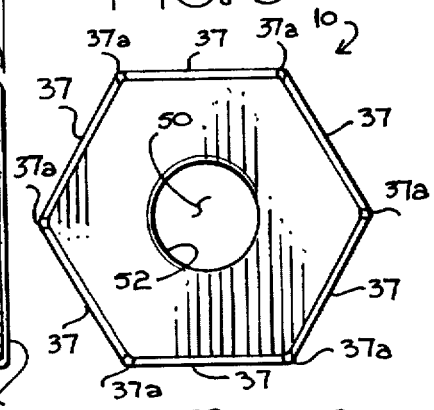
FIG. 3 is a outer end elevational view of the mandrel of FIG. 1.

With continuing reference to FIG. 1, and additional reference to FIG. 3, mandrel 10 is shown having a preferred generally hexagonal configuration. In particular, mandrel 10 includes a continuous exterior surface 35 being defined by six coextensive continuous exterior facets 37 thereby forming a generally hexagonal configuration, each exterior facet 37 being separated by a longitudinally extending edge 37*a* extending from inner end 25*a* to outer end 30*a*. It will be readily understood that although mandrel 10 has been herein specifically shown as having a generally hexagonal elongate configuration, any preferred and suitable configuration may be used such as triangular, square, generally cylindrical, or some other selected geometric configuration without departing from the nature and scope of the instant invention as herein disclosed.

Communicating from inner end 25*a* to outer end 30*a* of mandrel 10 is shown a generally horizontally disposed channel 40. Channel 40 is comprised of a counterbore 42 extending inwardly a terminal distance from inner end 25. Counterbore 42 is defined by a generally cylindrical inner sidewall 45 defining a diameter and an inwardly extending annular endwall 47. From annular endwall 47, counterbore 42 communicates with a bore 50 defined by a generally cylindrical inner wall 52 and further having a generally elongate and outwardly tapered configuration, bore 50 being generally horizontally disposed and further communicating with outer end 30*a*, with portions of inner wall 52 defining a diameter proximate outer end 30*a*. From the above discussion, it will be appreciated that inner end 25*a* and outer end 30*a* are thus defined as being open, with the diameter of inner end 25*a* being preferably and suitably greater that the diameter of outer end 30*a*.

Figure 4:
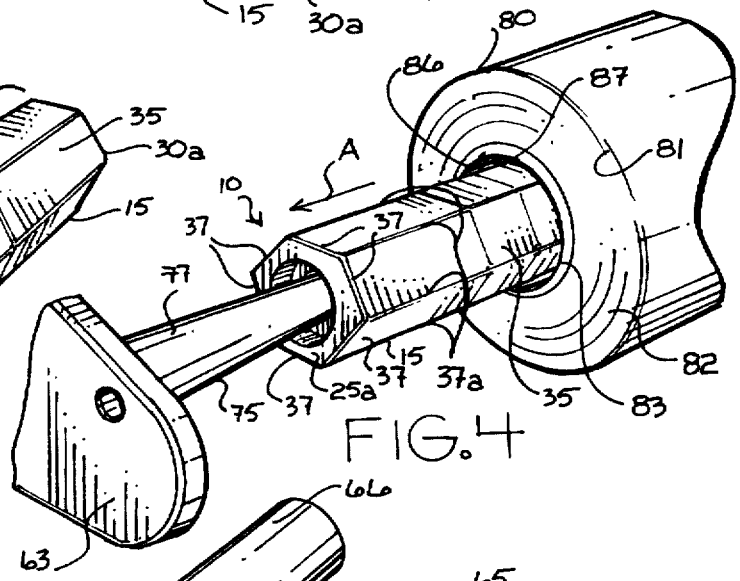
FIG. 4 is a perspective view of the mandrel of FIG. 1 shown as it would appear in use.
Figure 5:
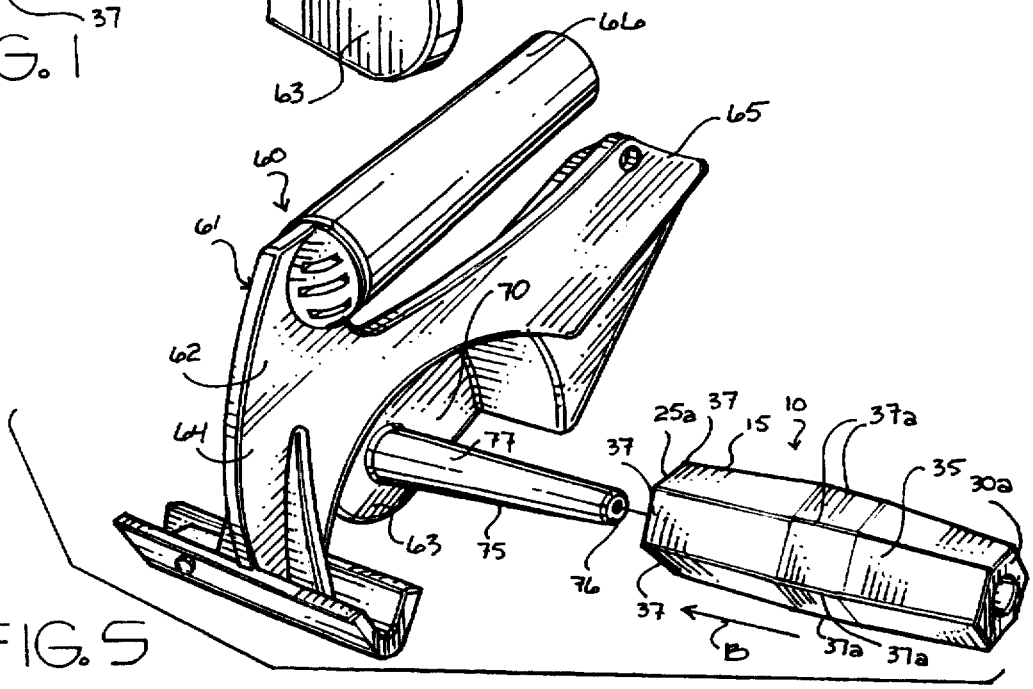
FIG. 5 is a perspective view of the mandrel of FIG. 1 shown as it would appear in relation to an apparatus for dispensing material from a roll.

With reference to FIG. 4 and FIG. 5, in operation, mandrel 10 is preferably suitable for use in combination with an apparatus 60 for dispensing material from a roll. Apparatus 60, details of which will be readily understood by those having ordinary skill, and which will further be understood as being consistent with a hand held masking machine, generally includes a frame 61 having substantially flat section 62 with a rearwardly extending handle 66 coupled thereto and a primary offset section 63. Primary offset section 63 includes an inner surface 70 having a shaft 75 extending outwardly therefrom and terminating with a free end 76. Shaft 75 includes a generally outwardly tapered configuration having a generally cylindrical outer surface 77. For purposes of orientation, it is considered that frame 61 includes a forward portion 64 and a rearward portion 65 as seen in FIG. 5. Frame 61, including each of the foregoing named elements, is integrally formed of plastic in accordance with conventional injection molding techniques.

In operation, mandrel 10 is rotatably receivable upon shaft 75 by introducing free end 76 of shaft 75 into channel 40 through counterbore 42 and therethrough into bore 50 in the direction indicated by arrow A in FIG. 4 and arrow B indicated in FIG. 5 such that inner wall 52 is rotatable about outer surface 77 of shaft 75. A roll 80 of coiled paper sheet 81 having an end 82, another end (not shown), a core 83 having a generally cylindrical inner surface 87 defining a bore 86 having a selected diameter, is retained by mandrel 10 by inserting the outer end 30*a* of outer lead portion 30 of mandrel 10 into bore 86 in the direction from free end 76 of shaft 75. The tapered configuration of outer lead portion 30 allows roll 80 to be easily introduced upon mandrel 10. Furthermore, when roll 80 is introduced upon mandrel 10, of which can further be seen in FIG. 7, each longitudinally extending edge 37*a* proximate raised portion 20 impinge or embed into and operates as an engagement elements for frictionally engaging inner surface 87 of core 83 thereby frictionally retaining roll 80 to mandrel 10, and thereby further inhibiting roll 80 from rotating about exterior surface 35 of mandrel 10.

It will be readily appreciated that a highly efficient mandrel has been herein described. It will be further understood that mandrel 10 may be specifically constructed and sized for retaining rolls of material having varying bore sizes, and that mandrel 10 may be easily introduced and removed from shaft 75 as selectively desired, the shaft 75 and the mandrel 10 functioning together as a roll holder. Consistent with the foregoing, an array of mandrels may be utilized consistent with the teachings herewith and specifically exploited as needed with rolls of material having varying and corresponding bore diameters.

Figure 6:
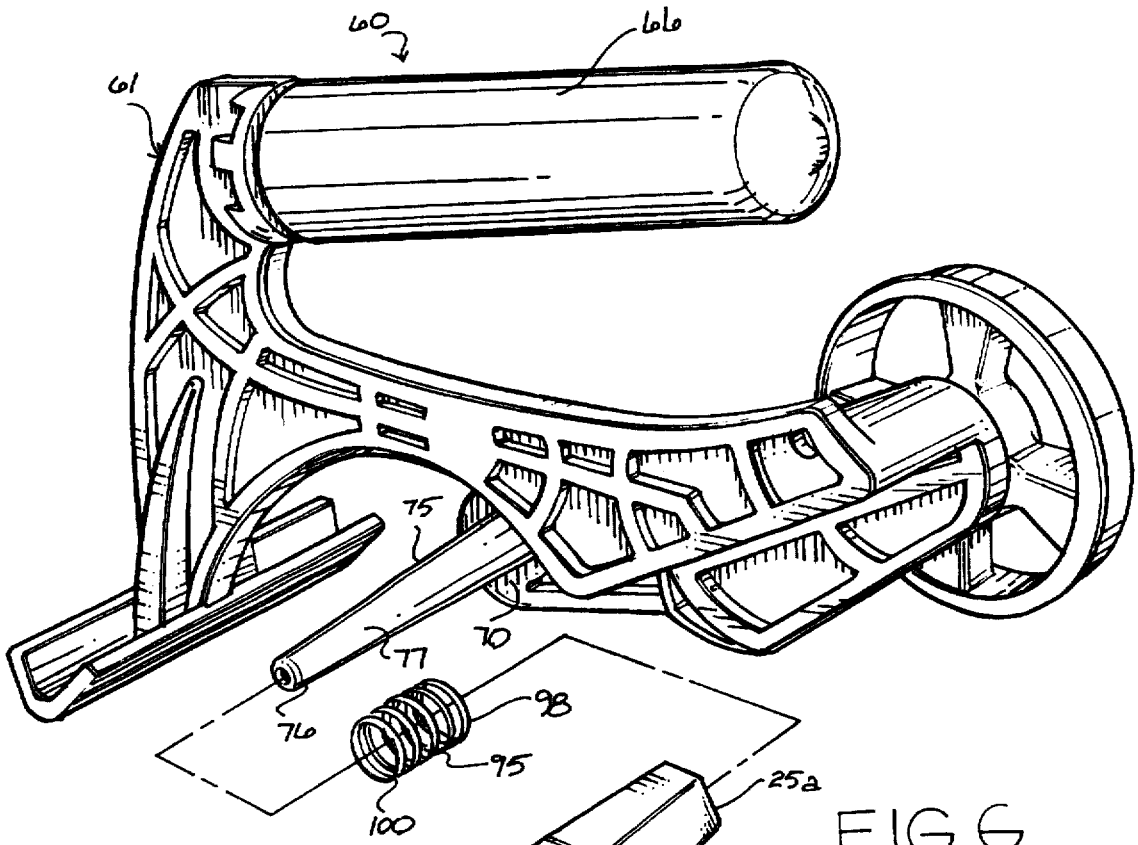
FIG. 6 is an enlarged exploded perspective view of the improvements constituting the instant invention appearing in position relative a hand held masking machine.
Figure 7:
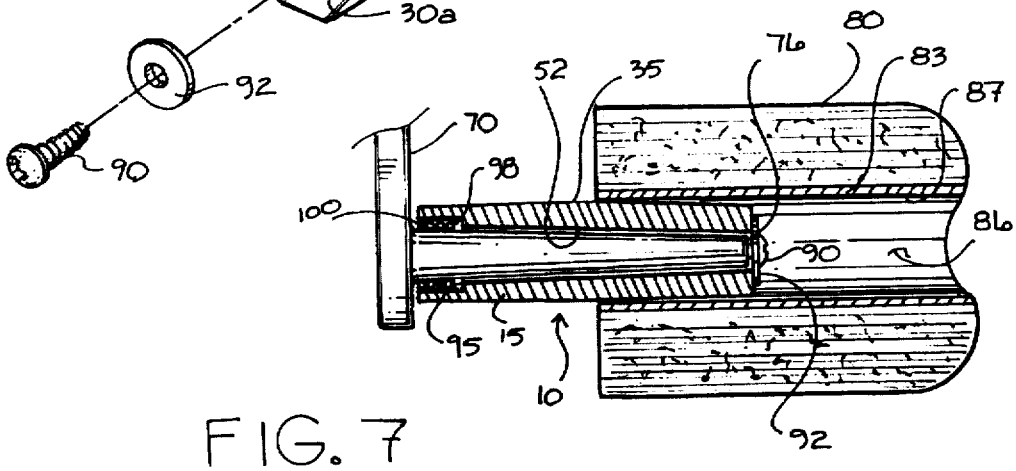
FIG. 7 is a sectional view of the embodiment of the mandrel first shown in FIG. 1, and further illustrating a roll of paper being installed thereon.

With attention directed to FIG. 6 and FIG. 7, illustrated is a preferred means by which mandrel 10 may be rotatably affixed to shaft 75. In particular, when mandrel 10 is carried or journaled about shaft 75 as herein earlier specifically described, screw 90, passing through washer 92 and outer end 30*a*, threadably engages free end 76 of shaft 75 for attachment of mandrel 10 to shaft 75. The screw 90 is preferably left hand threaded so that rotation of mandrel 10 keeps screw 90 tight. Further included is a biasing means comprising a compression spring 95 disposed thereupon shaft 75 proximate inner surface 70 of frame 61. The compression spring 95, substantially residing within counterbore 42, is disposed between inner surface 70 of frame 61 and inner end 25*a* and includes an outer end 98 which bears against annular endwall 47, and an inner end 100 which bears against inner surface 70 of frame 61. Compression spring 95 functions as a biasing means for normally urging mandrel 10 in outwardly away from inner surface 70.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An apparatus for dispensing material from a roll, said apparatus including:

a frame;

a shaft extending outwardly from said frame and terminating with a free end and having an outer surface;

a roll of material including a core, said core having a generally cylindrical inner surface defining a bore extending therethrough;

a unitary mandrel detachably and rotatably carried by said shaft, said mandrel including an exterior surface with a contact portion, an outer tapered lead portion, and an inner tapered lead portion, said contact portion of said mandrel being detachably engaged to said generally cylindrical inner surface of said core for detachably retaining said roll of material thereon; and means proximate said free end of said shaft for detachably retaining said unitary mandrel to said shaft while allowing said unitary mandrel to rotate upon said shaft.

2. The apparatus of claim 1, wherein said contact portion includes a raised portion generally intermediate said inner tapered lead portion and said outer tapered lead portion, said raised portion having an engagement surface for engaging portions of said generally cylindrical inner surface of said core.

3. The apparatus of claim 2, wherein said inner tapered lead portion terminates with an open inner end defining a diameter.

4. The apparatus of claim 3, wherein said outer tapered lead portion terminates with an open outer end defining a diameter smaller than said diameter of said open inner end.

5. The apparatus of claim 4, wherein said mandrel further includes a counterbore extending inwardly from said open inner end and terminating with an endwall.

6. The mandrel of claim 5, wherein said mandrel further includes a bore in communicating relation with said counterbore of said mandrel and said open outer end of said mandrel.

7. The mandrel of claim 6, wherein said bore of said mandrel is generally outwardly tapered.

8. The apparatus of claim 7, wherein said mandrel includes a generally hexagonal lateral cross section.

9. The mandrel of claim 5, further including biasing means carried by said shaft intermediate said frame and said open inner end of said mandrel, said biasing means for normally outwardly biasing said mandrel carried by said shaft.

10. The apparatus of claim 9, wherein said biasing means includes a compression spring.

* * * * *